US007513776B1

(12) United States Patent
Chen et al.

(10) Patent No.: US 7,513,776 B1
(45) **Date of Patent: *Apr. 7, 2009**

(54) PATCH PANEL

(75) Inventors: Fei-Hsu Chen, Taipei Hsien (TW); Tsann-Huei Chang, Taipei Hsien (TW); Han-Chieh Chang, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/960,750

(22) Filed: Dec. 20, 2007

(30) Foreign Application Priority Data

Dec. 4, 2007 (CN) ..... 2007 1 0202837

(51) Int. Cl.
*H01R 29/00* (2006.01)

(52) U.S. Cl. ..... 439/54

(58) Field of Classification Search ..... 439/54, 439/49, 912, 709, 712, 718, 719; 379/19, 379/24, 27, 29, 325–332, 399, 397
See application file for complete search history.

(56) References Cited

U.S. PATENT DOCUMENTS 5,145,380 A * 9/1992 Holcomb et al. ..... 439/49
6,039,578 A * 3/2000 Suffi et al. ..... 439/54
7,217,152 B1 * 5/2007 Xin et al. ..... 439/490

* cited by examiner

*Primary Examiner*—Edwin A. Leon
(74) *Attorney, Agent, or Firm*—Frank R. Niranjan

(57) ABSTRACT

A patch panel includes a plurality of signal input terminals, an output module having a plurality of signal output terminals and at least one standby signal output terminal, and a plurality of adapter elements each having a base portion and a slide portion slidably mounted on the base portion. The base portion includes a first contact connected to a corresponding signal output terminal and at least one standby contact connected to the at least one standby signal output terminal. The slide portion includes a second contact connected to a corresponding signal input terminal. The second contact selectively electrically contacts the corresponding first contact or the at least one standby contact by sliding of the slide portion from an initial position to another position.

5 Claims, 6 Drawing Sheets

PATCH PANEL

BACKGROUND

1. Field of the Invention

The present invention relates to patch panels.

2. Description of Related Art

Generally speaking, after a printed circuit board (PCB), such as a motherboard, is assembled, it needs to be tested via a patch panel and a tester.

Referring to FIG. 1, a conventional patch panel is shown. The patch panel includes a connector 100 having nine signal input terminals 120, and an output module 200 having nine signal output terminals 220 and two standby signal output terminals 240. The nine signal input terminals 120 are respectively connected to the nine signal output terminals 220. When a motherboard needs to be tested, a tester is connected to the connector 100 via the connector of the tester, and a plurality of test pins of the motherboard are respectively connected to a plurality of the signal output terminals 220, and then the tester will test the motherboard via the patch panel.

When a connecting line of the patch panel is broken, an extra connecting line is used to connect the unconnected input terminal 120 to a standby output terminal 240. However, this method the extra connecting line be welded to the unconnected input terminal 120 and the standby output terminal 240, which is very inconvenient and may damage the patch panel.

What is needed is to provide a patch panel which overcomes the above problems.

SUMMARY

An embodiment of a patch panel includes a plurality of signal input terminals, an output module having a plurality of signal output terminals and at least one standby signal output terminal, and a plurality of adapter elements each having a base portion and a slide portion slidably mounted on the base portion. The base portion includes a first contact connected to a corresponding signal output terminal and at least one standby contact connected to the at least one standby signal output terminal. The slide portion includes a second contact connected to a corresponding signal input terminal. The second contact selectively electrically contacts the corresponding first contact or the at least one standby contact by sliding of the slide portion from an initial position to another position.

Other advantages and novel features of the present invention will become more apparent from the following detailed description of an embodiment when taken in conjunction with the accompanying drawings, in which:

DETAILED DESCRIPTION

Figure 1:
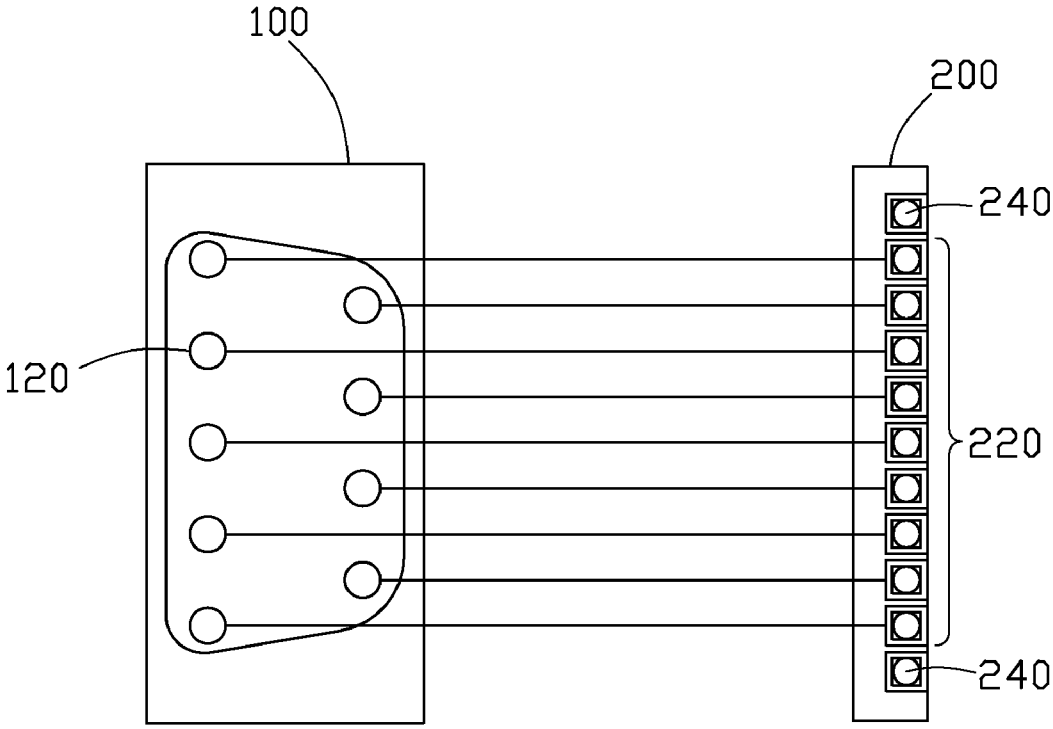
FIG. 1 (RELATED ART)
FIG. 1 is a schematic view of a conventional patch panel.
Figure 2:
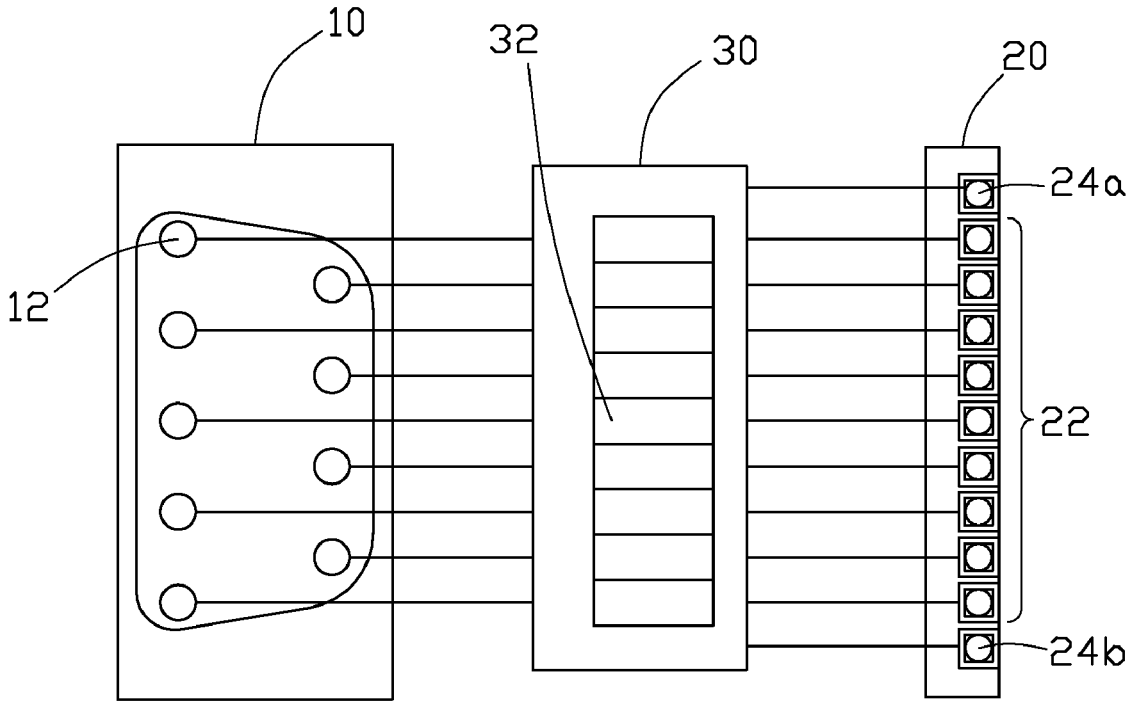
FIG. 2 is a schematic view of a patch panel in accordance with an embodiment of the present invention.

Referring to FIGS. 2 to 6, a patch panel in accordance with an embodiment of the present invention includes a connector

10, an output module 20, and an adapter module 30. The connector 10 includes nine signal input terminals 12. The output module 20 includes nine signal output terminals 22 and two standby signal output terminals 24*a* and 24*b*. The adapter module 30 includes nine adapter elements 32. In other embodiments, the amounts of the signal input terminals 12, the signal output terminals 22, the standby signal output terminals 24*a* and 24*b*, and the adapter elements 32 can be changed according to need.

Each of the adapter elements 32 includes a base portion 322 and a slide portion 324 slidably mounted on the base portion 322. Each base portion 322 includes a first contact 3222 connected to a corresponding signal output terminal 22 and two standby contacts 3224*a* and 3224*b* respectively connected to the two standby signal output terminals 24*a* and 24*b*. Each slide portion 324 includes a second contact 3242 connected to a corresponding signal input terminal 12. Each second contact 3242 can be selectively electrically contacted to the corresponding first contact 3222 or one of the two standby contacts 3224*a* and 3224*b* by manually sliding the slide portion 324. In this embodiment, the slide portion 324 is slidably mounted on the base portion 322 via a dovetail configuration (shown in FIG. 6).

Figure 3:
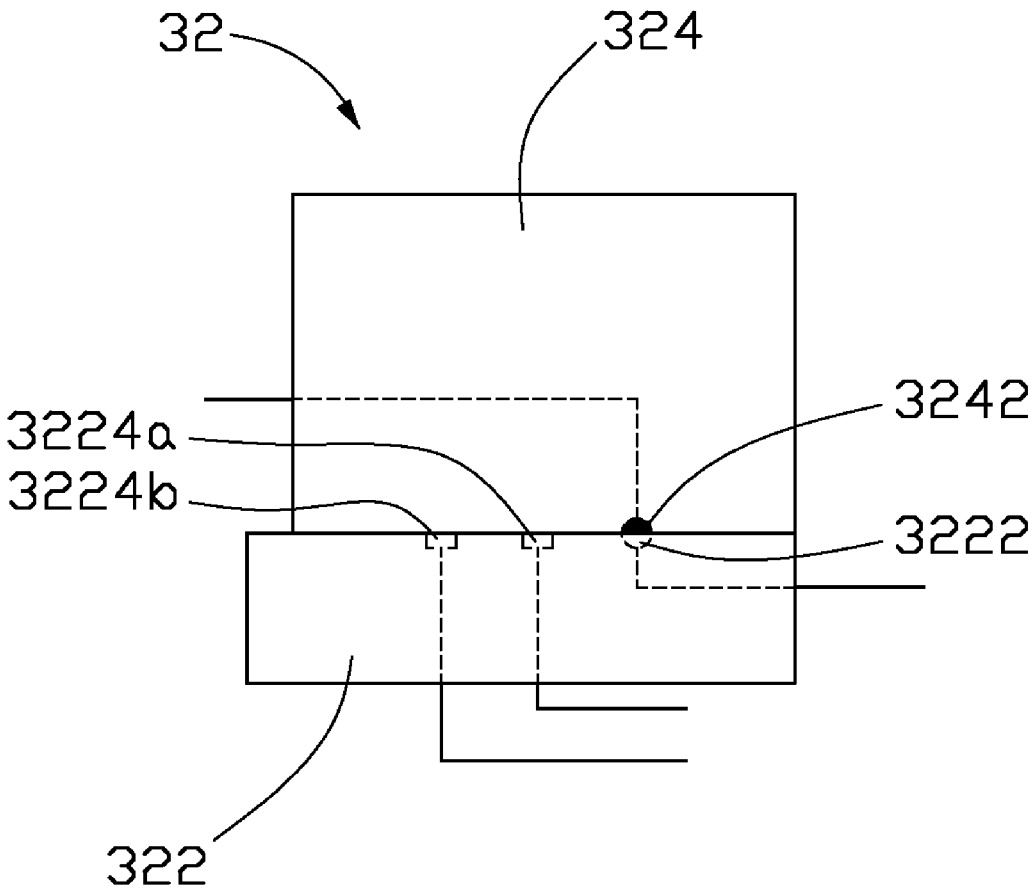
FIG. 3 is a cross-sectional view of an adapter element of the patch panel of FIG. 2.
Figure 4:
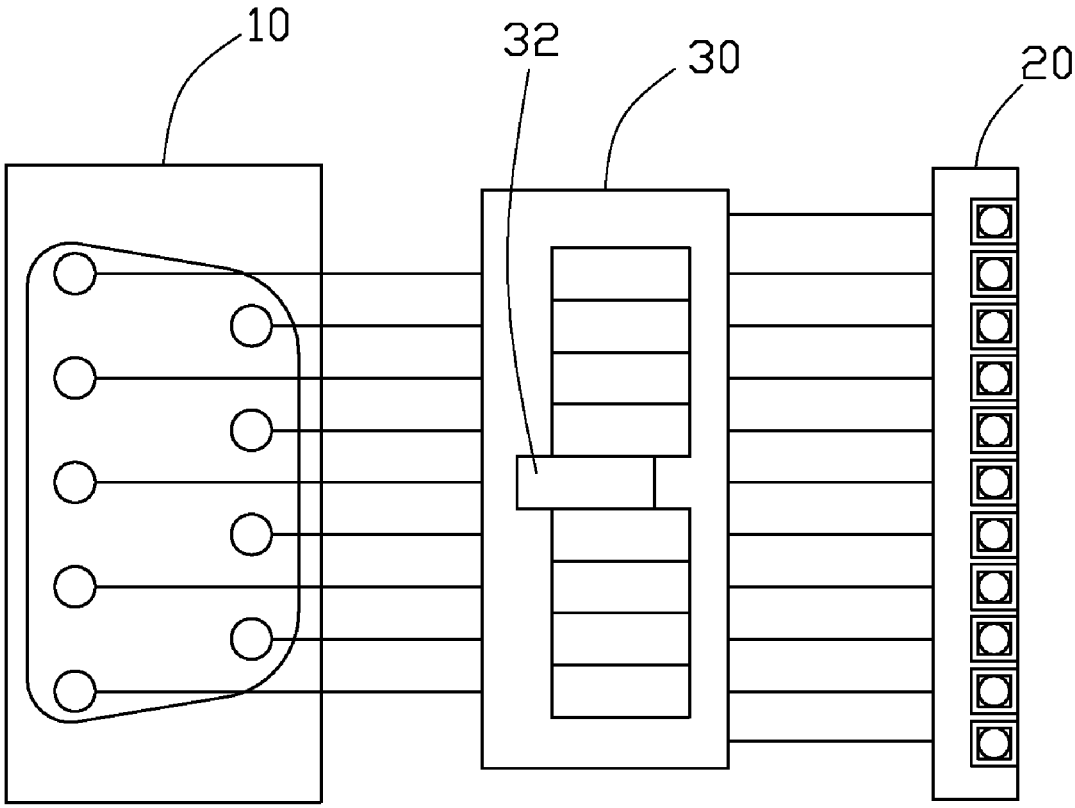
FIG. 4 is a schematic view of the patch panel of FIG. 2 when an adapter element thereof is slid to another position.
Figure 5:
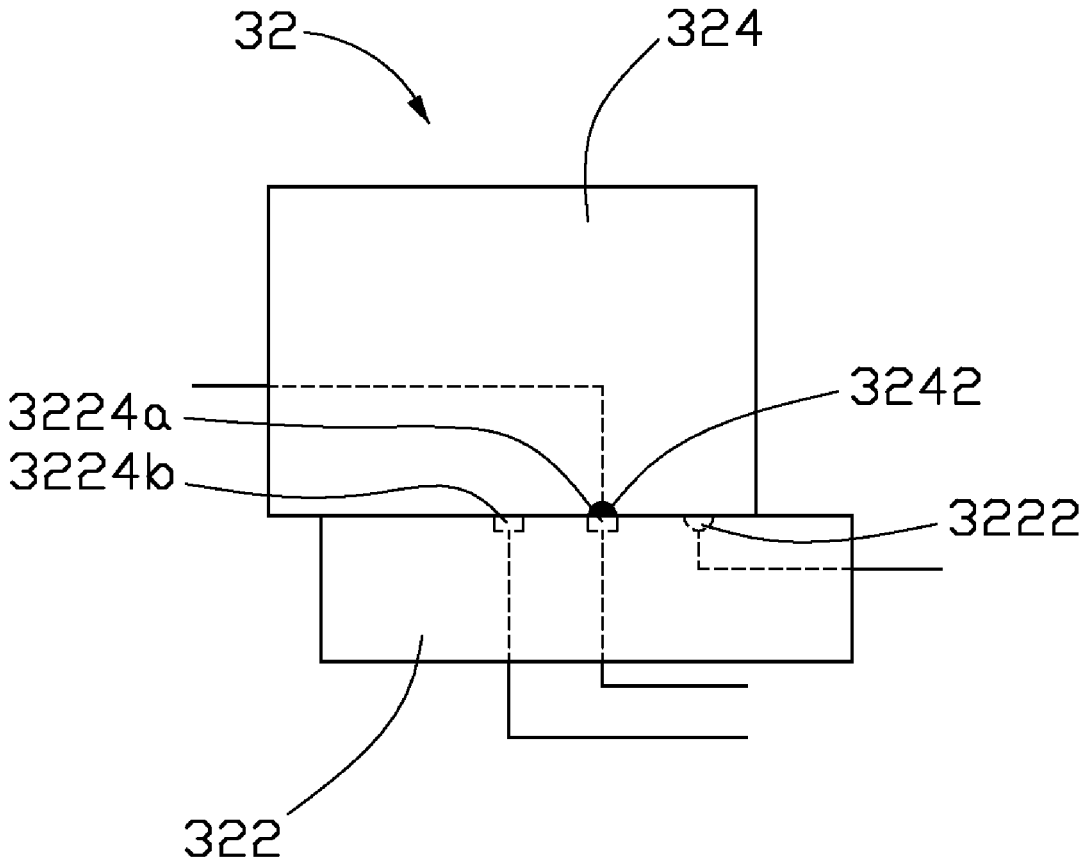
FIG. 5 is a cross-sectional view of an adapter element of the patch panel of FIG. 4.
Figure 6:
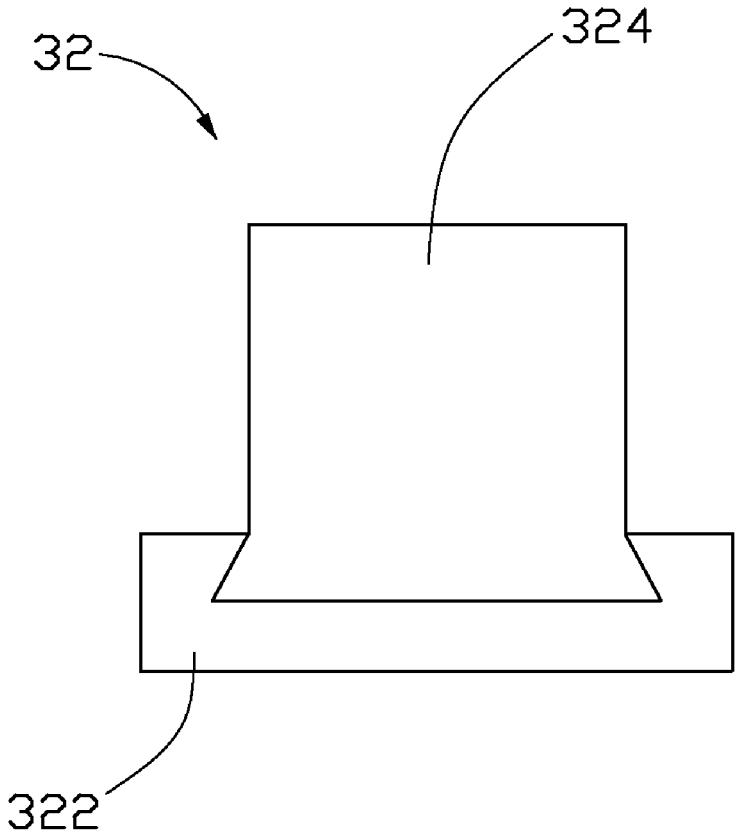
FIG. 6 is a rear elevational view of the adapter element of FIG. 3.

In use, if all connecting lines of the patch panel are good, each of the slide portions 324 is located at an initial position (shown in FIG. 3). The first contact 3222 of each base portion 322 electrically contacts the second contact 3242 of the corresponding slide portion 324. The patch panel works normally.

If one connecting line of the patch panel is broken, the slide portion 324 of the corresponding adapter element 32 is manually slid to a second position to make the second contact 3242 thereof electrically contact the corresponding standby contact 3224*a*. Thereby, the patch panel can work normally again, which is very convenient.

If two connecting lines of the patch panel is broken, the slide portion 324 of one corresponding adapter element 32 is manually slid to a second position to make the second contact 3242 thereof electrically contact the corresponding standby contact 3224*a*, and the slide portion 324 of the other corresponding adapter element 32 is manually slid to a third position to make the second contact 3242 thereof electrically contact the corresponding standby contact 3224*b*. Thereby, the patch panel can work normally again, which is very convenient.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A patch panel comprising:

a plurality of signal input terminals;

an output module having a plurality of signal output terminals and at least one standby signal output terminal; and a plurality of adapter elements each having a base portion and a slide portion slidably mounted on the base portion, the base portion comprising a first contact connected to a corresponding signal output terminal and at least one standby contact connected to the at least one standby signal output terminal, the slide portion comprising a second contact connected to a corresponding signal input terminal, the second contact selectively electrically contacting the corresponding first contact or the at least one standby contact by sliding of the slide portion from an initial position to another position.

2. The patch panel as claimed in claim 1, wherein each of the slide portions is slidably mounted on the base portion via a dovetail configuration.

3. The patch panel as claimed in claim 1, wherein the amounts of the signal input terminals, the signal output terminals, and the adapter elements are the same.

4. The patch panel as claimed in claim 1, wherein the amounts of the at least one standby output terminal and the at least one standby contact are both two.

5. The patch panel as claimed in claim 1, wherein the signal input terminals are arranged in a connector configured for connecting to a tester.

* * * * *